US007558509B2

(12) United States Patent
Konishi

(10) Patent No.: US 7,558,509 B2
(45) Date of Patent: Jul. 7, 2009

(54) IMAGE FORMING APPARATUS

(75) Inventor: Hidehisa Konishi, Osaka (JP)

(73) Assignee: Kyocera Mita Corporation (JP)

( * ) Notice: Subject to any disclaimer, the term of this patent is extended or adjusted under 35 U.S.C. 154(b) by 557 days.

(21) Appl. No.: 11/487,266

(22) Filed: Jul. 14, 2006

(65) Prior Publication Data

US 2007/0019991 A1 Jan. 25, 2007

(30) Foreign Application Priority Data

Jul. 25, 2005 (JP) ..... 2005-214699

(51) Int. Cl.
*G03G 15/00* (2006.01)

(52) U.S. Cl. ..... 399/167; 399/223

(58) Field of Classification Search ..... 399/167, 399/223

See application file for complete search history.

(56) References Cited

U.S. PATENT DOCUMENTS 5,848,333 A * 12/1998 An ..... 399/167
2006/0239716 A1* 10/2006 Kim et al. ..... 399/223

FOREIGN PATENT DOCUMENTS

JP 10-319673 12/1998
JP 2003-345101 12/2003

* cited by examiner

*Primary Examiner*—David M Gray
*Assistant Examiner*—Ryan D Walsh
(74) *Attorney, Agent, or Firm*—Gerald E. Hespos; Anthony J. Casella

(57) ABSTRACT

A controller of an image forming apparatus determines whether switching of a monochromatic recording mode to a color recording mode is necessary or not. In the case where the controller determines that the switching is necessary, the controller controls stepping motors of respective image forming units corresponding to respective colors of yellow, cyan, magenta and black to lower their outputs. Then, the controller controls a power transmission mechanism to execute a connecting operation so as to transmit a driving force to each of the image forming units corresponding to yellow, cyan and magenta. At the timing when the color printing should be performed, the controller controls respective developing rollers to start performing a developing operation in order of yellow, cyan, magenta and black.

8 Claims, 7 Drawing Sheets

IMAGE FORMING APPARATUS

BACKGROUND OF THE INVENTION

1. Field of the Invention

The invention relates to a so-called tandem image forming apparatus including a plurality of image forming units provided in accordance with a plurality of toners having different colors and arranged in a predetermined direction to superimposedly transfer toner images of respective colors to a recording sheet being conveyed in the predetermined direction.

2. Description of the Related Art

Conventionally, a so-called tandem image forming apparatus including a plurality of image forming units arranged in one direction for forming toner images of respective colors of cyan, magenta, yellow and black to superimposedly transfer the toner images of the respective colors onto a recording sheet being conveyed in the arrangement direction is known (refer to Japanese Unexamined Patent Publication No. 2003-345101, for example).

This kind of image forming apparatus includes image forming units each including a photoconductive drum for bearing an electrostatic latent image and a developing device which is provided near the photoconductive drum. The image forming units are provided in accordance with respective colors of cyan, magenta, yellow and black. Each of the developing devices having toners of the respective colors develops an electrostatic latent image individually. After toner images of respective colors are transferred successively to a transferring belt, the toner images are transferred to a recording sheet and fixed by a fixing device.

Further, in the case of performing monochromatic printing is performed by such color image forming apparatus as described above, it is necessary to construct the image forming apparatus so that a developing operation is not executed with regard to the colors other than black e.g., cyan, magenta and yellow. Accordingly, each image forming unit is so constructed that the photoconductive drum and the developing device are driven by a common motor. Furthermore, in each of the image forming units corresponding to toners of cyan, magenta and yellow, is provided with a separating mechanism which makes and breaks a power transmission path between the motor and the developing device. In general, the separating mechanism is so constructed that it constantly transmits a driving force generated by the motor to the photoconductive drum constantly, and, on the other hand, it transmits the driving force to the developing device when needed (in the case of performing a color printing).

Further, Japanese Unexamined Patent Publication No. HEI10-319673 discloses an image forming apparatus including a plurality developing devices storing toners of respective colors of cyan, magenta, yellow and black arranged around a predetermined rotational axis and are held by a holding member, and a step motor which drives the holding member so as to rotate each developing device about the rotational axis to switch the developing devices for feeding toner particles to a photoconductive drum. In the image forming apparatus, the step motor executes microstep driving at the start time to prevent step-out and noise of the step motor occurred at the time of switching the developing device.

In the former tandem image forming apparatus, at the time when a state of performing a printing is switched from a monochromatic printing to a color printing and the separating mechanism makes a power transmission path between the motor and the developing device, a load by the developing device is applied to the motor instantaneously. Since the developing device has a relatively large weight, a great load is applied on the motor. Consequently, step-out of the motor occurs in some cases.

Further, in the latter image forming apparatus, the step motor executes the microstep driving at the start time. Consequently, a construction of a driving circuit becomes complicated, and a use of an expensive step motor which is capable of executing the microstep driving is needed.

SUMMARY OF THE INVENTION

An object of the invention is to provide an image forming apparatus capable of suppressing or eliminating step-out occurred in a driving section with a simple construction.

An aspect of the present invention is directed to an image forming apparatus comprises: an image bearing member for bearing an electrostatic latent image; a driving section for driving the image bearing member; a developing section for developing the electrostatic latent image formed on the image bearing member by toner particles; a power transmission section provided between the driving section and the developing section for making and breaking a power transmission path of transmitting a driving force generated by the driving section to the developing section; and a controller for controlling the driving section and the power transmission section, the controller controlling the driving section to lower its output to a predetermined value before transmitting a driving force of the driving section to the developing section, and controlling the power transmission section to make the power transmission path between the driving section and the developing section after the output of the driving section is lowered to the predetermined value.

In the image forming apparatus, when the need to transmit the driving force generated by the driving section to the developing section arises, the power transmission path between the driving section and the developing section is made after the output of the developing section is lowered to the predetermined value. Accordingly, when the power transmission path is made, a great load applied to the driving section by the developing section can be prevented or suppressed. Consequently, step-out of the driving section can be suppressed or eliminated with a simple construction.

DETAILED DESCRIPTION OF THE PREFERRED EMBODIMENTS

Figure 1:
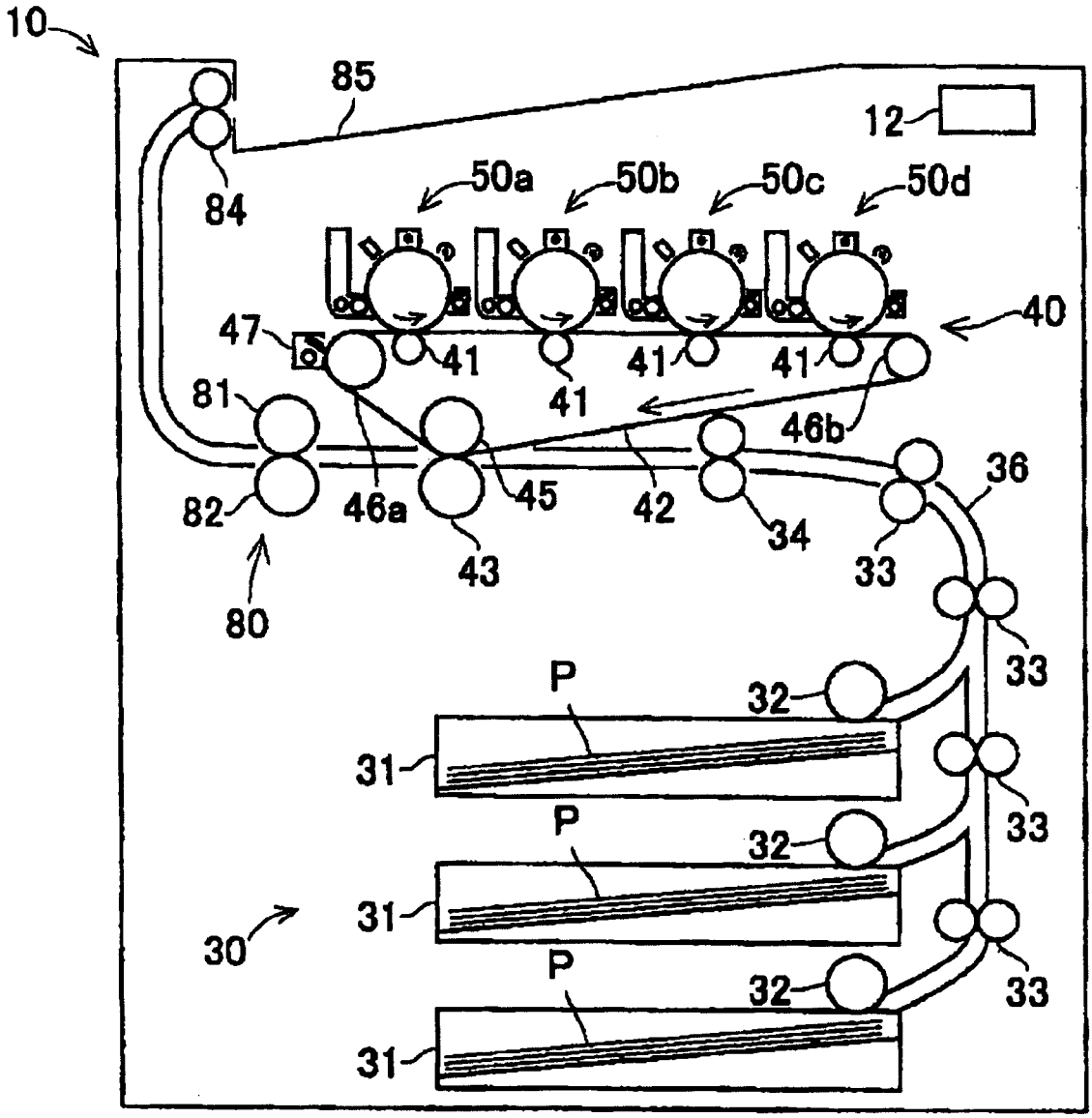
FIG. 1 is a view showing a construction of a printer according to an embodiment of the invention.

Hereinafter, a printer is described as an example of an image forming apparatus according to an embodiment of the present invention. FIG. 1 is a view showing a construction of a printer according to an embodiment of the invention.

As shown in FIG. 1, a printer 10 includes a controller 12, a sheet feeding section 30, an image forming section 40 and a fixing section 80.

The controller 12 includes an unillustrated storing portion for storing a control program of controlling an operation of the printer 10 and a microcomputer for reading out the control program from the storing portion and executing the same and controls operations of the printer 10 such as a sheet conveyance operation and an image forming operation.

The sheet feeding section 30 includes a sheet feeding cassette 31, a sheet feeding roller 32, a pair of conveyance rollers 33 and a pair of registration rollers 34. The sheet feeding cassette is provided in a lower portion of the printer 10 and stores recording sheets P. The sheet feeding roller 32 sends out the recording sheets P stored in the sheet feeding cassette 31 one after another from the topmost of a stack toward a sheet conveyance passage 36. The recording sheet P sent out to the sheet conveyance passage 36 is conveyed to the image forming section 40 by the pair of conveyance rollers 33 and the pair of registration rollers 34.

The image forming section 40 includes four image forming units 50*a*, 50*b*, 50*c*, 50*d* for respective colors of yellow, cyan, magenta and black, four primary transferring rollers 41, an intermediate transferring belt 42 and a belt cleaning device 47.

The image forming units 50*a*, 50*b*, 50*c*, 50*d* are serially arranged in a horizontal direction in FIG. 1. At positions facing the respective image forming units 50*a*, 50*b*, 50*c*, 50*d* through the intermediate transferring belt 42, the primary transferring rollers 41 are provided.

The intermediate transferring belt 42 tensionally bridges a driving roller 45 and driven rollers 46*a*, 46*b*. Each of the image forming units 50*a*, 50*b*, 50*c*, 50*d* comes in contact with an upper outer surface of the intermediate transferring belt 42. The driving roller 45 drives the intermediate transferring belt 42 so that the intermediate transferring belt 42 is rotated in a clockwise direction (a direction of an arrow) in FIG. 1.

The belt cleaning device 47 includes a blade which comes in contact with the transferring belt 42 for scraping off toner particles on the intermediate transferring belt 42 to remove toner particles which are not transferred to the recording sheet P but resided on the intermediate transferring belt 42.

Figure 2:
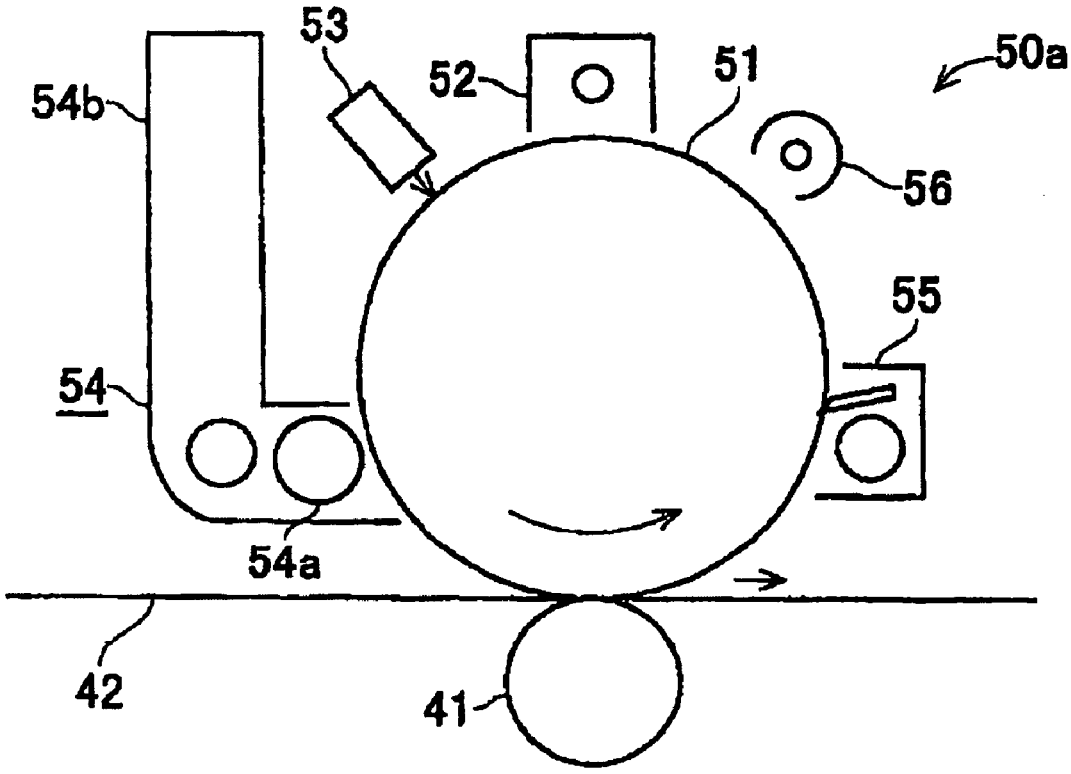
FIG. 2 is a partial enlarged view showing a vicinity of an image forming unit shown in FIG. 1.

Since the image forming units 50*a*, 50*b*, 50*c*, 50*d* execute image forming in the same manner, the image forming operation is described by referring to the image forming unit 50*a* as an example. FIG. 2 is a partial enlarged view of a vicinity of the image forming unit 50*a*. As shown in FIG. 2, the image forming unit 50*a* includes a photoconductive drum 51, a charging device 52, an LED print head 53, a developing device 54, a cleaning device 55 and a charge removing device 56.

The photoconductive drum 51 is rotated synchronously with a rotation of the intermediate transferring belt 42. In a periphery of the photoconductive drum 51 along a rotational direction (a direction of an arrow) from upper part thereof, the charging device 52, the LED print head 53 and the developing section 54 are arranged in order. Behind a contact portion between the photoconductive drum 51 and the intermediate transferring belt 42, the cleaning device 55 and the charge removing device 56 are arranged in order. The photoconductive drum 51 is an example of the image bearing member.

Referring to FIG. 1 again, the fixing section 80 includes a fixing roller 81 and a pressing roller 82. The fixing roller 81 and the pressing roller 82 come in contact with each other pressingly so that a toner image transferred to the recording sheet P is heated and pressed to be fixed onto the recording sheet P.

In the printer 10 having such construction, if an instruction of image forming is executed by an unillustrated external computer connected via a communication network, the controller 12 receives the instruction and controls an operation of each portion. Namely, in FIGS. 1 and 2, the driving roller 45 rotates the intermediate transferring belt 42 in the direction of an arrow. At this time, the respective photoconductive drums 51 of the image forming units 50*a*, 50*b*, 50*c*, 50*d* while come in contact with the intermediate transferring belt 42 and are rotated in a counter-clockwise direction (a direction of an arrow). Accordingly, a surface of each photoconductive drum 51 is evenly charged by the charging device 52 at first.

Next, based on a document image data transmitted from the external computer, the LED print head 53 including a plurality of LEDs irradiates light rays to erase electric load on the surface of the photoconductive drum 51 corresponding to portions of the image to be formed on the recording sheet P or portions other than the image to thereby form an electrostatic latent image is formed on the surface of the photoconductive drum 51. Then, a developing roller 54*a* provided in the developing device 54 feeds toner particles from a toner container 54*b* onto the photoconductive drum 51 to thereby expose the electrostatic latent image as a toner image. The developing roller 54*a* (developing rollers 54*b* to 54*d*) is an example of the developing section.

When the photoconductive drum 51 is further rotated and the toner image reaches to a position facing the primary transferring roller 41 through the intermediate transferring belt 42, a bias voltage having an inversed polarity with respect to the charged polarity of the toner particles is applied to the primary transferring roller 41. Accordingly, the toner image is transferred from the photoconductive drum 51 to the intermediate transferring belt 42. The toner particles which are not transferred but resided is removed by the cleaning device 55, and the electric charge resided on the surface of the photoconductive drum 51 is removed by the charge removing device 56.

The toner images are transferred respectively from the image forming units 50*a*, 50*b*, 50*c*, 50*d* onto the intermediate transferring belt 42 and superimposed thereon. When the intermediate transferring belt 42 is further rotated and the superimposed toner image reaches a position facing a secondary transferring roller 43, the recording sheet P is synchronously conveyed to a portion between the intermediate transferring belt 42 and the secondary transferring roller 43 through the sheet conveyance passage 36. At this time, a bias voltage having an inversed polarity with respect to the charged polarity of the toner particles is applied to the secondary transferring roller 43. Accordingly, the superimposed toner image is transferred from the intermediate transferring belt 42 to the recording sheet P. The toner particles which are not transferred to the recording sheet P but resided on the intermediate transferring belt 42 are removed from the intermediate transferring belt by a belt cleaning device 47. The recording sheet P on which the toner image is transferred is conveyed to the fixing section 80. Then, as described above, the toner image is heated and pressed by the fixing section 80 to be fixed on the recording sheet and is discharged by a pair of sheet discharging roller 84 onto a sheet discharging tray 85 provided on an upper portion of the printer 10.

Figure 3:
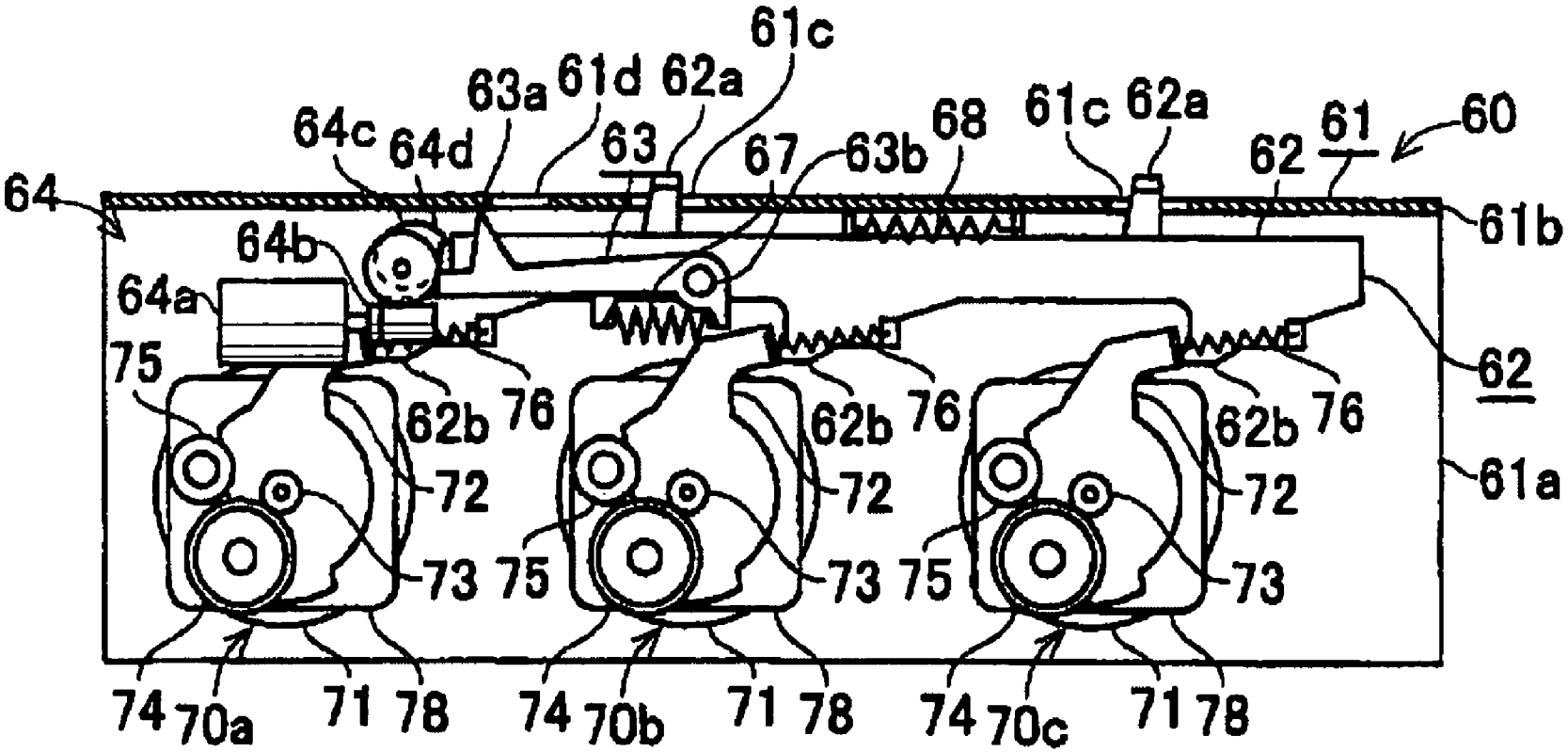
FIG. 3 is a view showing a state where a power transmission mechanism of the printer shown in FIG. 1 is disconnected.

A rotational driving force is transmitted to the photoconductive drums 51 and the developing roller 54*a* of the respective image forming units 50*a*, 50*b*, 50*c* by a power transmission mechanism 60 described hereinafter. FIG. 3 is a view showing a state where the power transmission mechanism 60 is disconnected, and FIG. 4 is a view showing a state where the power transmission mechanism 60 is connected.

Figure 4:
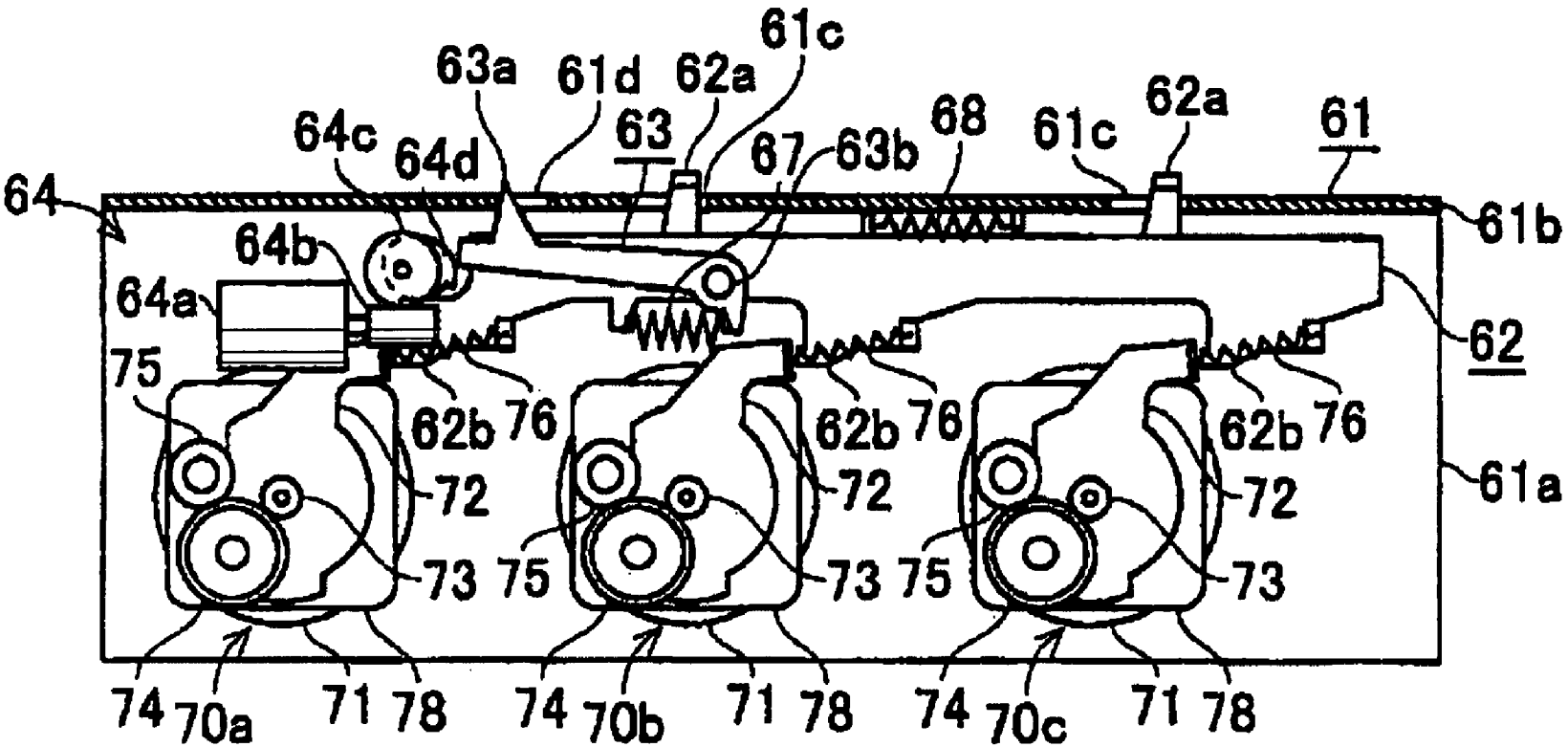
FIG. 4 is a view showing a state where a power transmission mechanism of the printer shown in FIG. 1 is connected.

The power transmission mechanism 60 is provided in a back side of the image forming section 40 in FIG. 1 and includes a frame body 61, a sliding member 62, a locking member 63, a cam mechanism 64, a coil spring 68 and three sets of clutch mechanisms 70*a*, 70*b*, 70*c*, as shown in FIGS. 3 and 4. The power transmission mechanism 60 is an example of the power transmission section.

The frame body 61 consists of plates made of metal, plastic and the like and includes a vertical portion 61*a* and a horizontal portion 61*b*. A cross section of the horizontal portion 61*b* is shown in FIGS. 3 and 4, and guiding holes 61*b* are formed in the horizontal portion 61*b*.

A plurality of projections provided in an upper portion of the sliding member 62 are engaged with the respective guiding holes 61*b* so that the sliding member 62 is made slidable with respect to the frame body 61. The frame body 61 and the sliding member 62 are connected through the compressed coil spring 68 so that the sliding member 62 is biased in a leftward direction with respect to the frame body 61 in FIGS. 3 and 4.

The sliding member 62 is provided with engaging portions 62*b* each engaged with respective arms 72 of the clutch mechanisms 70*a*, 70*b*, 70*c*. An extension coil spring 76 is attached to each of the engaging portions 62*b* and the arms 72. Further, the locking member 63 is attached to the sliding member rotatably about a supporting point 63*b* and is biased by the extension coil spring 67 attached between the sliding member 62 and the locking member 63 so that a free end side of the locking member 63 rotated toward a direction of an upper locking position. At an upper portion of the free end of the locking member 63, a locking projection 63*a* is provided.

The cam mechanism 64 includes a cam driving motor 64*a* fixed on the vertical portion 61*a* of the frame body 61, a worm gear 64*b* attached to a rotational shaft of the cam driving motor 64*a*, a cam gear 64*c* attached to the frame body 61 to be engaged with the worm gear 64*b* and a cam 64*d* rotated integrally with the cam gear 64*c*. Since the cam driving motor 64*a* is rotatable in either directions, the cam 64*d* can be rotated either in a clockwise direction or in a counter-clockwise direction in FIGS. 3 and 4.

Herein, operations of the sliding member 62, the locking member 63 and the cam mechanism 64 are described. If the cam 64*d* is rotated in a counter clockwise direction when the power transmission mechanism 60 is in the state shown in FIG. 3, the cam 64*d* comes in contact with the free end of the locking member 63, and a distance between a shaft of the cam 64*d* and a portion being in contact with a peripheral surface of the locking member 63 becomes longer. Thus, the sliding member 62 resists against a biasing force of the coil spring 68 and is moved with the locking member 63 in a rightward direction. If the cam 64 is further rotated, the locking member 63 is rotated upward by a biasing force generated by the coil spring 67. Then, the locking projection 63*a* is placed in a locking hole 61*d* formed in the horizontal portion 61*b* of the frame body 61. Accordingly, the locking member 63 is positioned at a locking position.

Thereafter, as the distance between the shaft of the cam 64*d* and a portion of the peripheral surface of the locking member 63 being in contact with the cam 64*d* becomes shorter, the sliding member 62 biased by the coil spring 68 is moved in a leftward direction. However, when the locking projection 63*a* engages with the locking hole 61*d*, the sliding member 62 cannot move farther in the leftward direction as shown in FIG. 4. Accordingly, a position of the sliding member 62 is retained in a disengaging position with respect to the clutch mechanisms 70*a*, 70*b*, 70*c*.

As described above, since the sliding member 62 is moved to the engagement releasing position with respect to the clutch mechanisms 70*a*, 70*b*, 70*c* while the cam 64*d* rotates one time in a counter clockwise direction, it is not necessary to further supply an electric power to the cam driving motor 64*a*. Further, if the cam 64*d* is rotated in the same direction thereafter, the sliding member 62 could be moved by the cam 64*d* in a rightward direction from the disengaging position with respect to the clutch mechanisms 70*a*, 70*b*, 70*c*. However, the sliding member 62 does not go back to the engaging position with respect to the clutch mechanisms 70*a*, 70*b*, 70*c* shown in FIG. 3.

On the other hand, if the cam 64*d* is rotated in a clockwise direction when the power transmission mechanism 60 is in the state shown in FIG. 4, the free end of the locking member 63 hooks to a projection formed on the peripheral surface of the cam 64*d*. The projection is hooked only when the cam 64*d* is rotated in a clockwise direction to thereby drag down the free end of the locking member 63. Consequently, the locking projection 63*a* and the locking hole 61*d* are disengaged, and the sliding member 62 biased by the coil spring 68 is moved in a leftward direction so that the sliding member 62 is to be positioned at the engagement position with respect to the clutch mechanisms 70*a*, 70*b*, 70*c* shown in FIG. 3.

As described above, since the sliding member 62 is moved to the engaging position with respect to the clutch mechanisms 70*a*, 70*b*, 70*c* while the cam 64*d* rotates one time in a clockwise direction, it is not necessary to further supply an electric power to the cam driving motor 64*a*. Herein, the locking member 63 is urged to turn upward by the coil spring 67. However, the locking member 63 comes in contact with the horizontal portion 61*b* of the frame body 61 and restricted from rotating farther. Accordingly, the locking member 63 is kept at the unlocking position. Further, if the cam 64*d* keeps rotating in the same direction, the free end of the locking member 63 is dragged down by the projection of the cam 64*d*. However, if the projection is disengaged, the sliding member moves back to the lock releasing position by the coil spring 67. Accordingly, the sliding member 62 is not moved from the engagement position with respect to the clutch mechanisms 70*a*, 70*b*, 70*c*.

Next, the clutch mechanisms 70*a*, 70*b*, 70*c* are described hereafter. The clutch mechanisms 70*a*, 70*b*, 70*c* have substantially the same construction and each includes a stepping motor 71 fixed on the vertical portion 61*a* of the frame body 61, a driving gear 73 connected to a shaft of the stepping motor 71, an arm 72 attached rotatably about an axis line of the stepping motor 71, an idle gear 74 rotatably attached to the arm 72 and an output gear 75 rotatably attached to a plate 78 fixed to the stepping motor 71. The stepping motor 71 is an example of the driving section.

In the state shown in FIG. 3, the arms 72 are biased so as to be engaged with the respective engaging portions 62*b* of the sliding member 62 biased at the engaging position with respect to the respective clutch mechanisms 70*a*, 70*b*, 70*c* and is rotated in a leftward direction. Accordingly, the clutch mechanisms 70*a*, 70*b*, 70*c* are in the state where the idle gear 74 and the output gear 75 are separated, namely, in the state where the power transmission path is broken. Consequently, a power of the stepping motor 71 is not transmitted to the output gear 75.

Further if the cam 64*d* is rotated in a counter-clockwise direction in the state shown in FIG. 3, the sliding member 62 is moved to the rightward engagement releasing position with respect to the clutch mechanisms 70*a*, 70*b*, 70*c*, as stated above. The arms 72 are pulled by the coil springs 76 attached to the respective engaging portions of the sliding members 62. Accordingly, the arm 72 is rotated in a clockwise direction from the state shown in FIG. 3 so that the clutch mechanisms 70*a*, 70*b*, 70*c* are shifted to the connecting state where the idle gears 74 and the respective output gears 75 are engaged, namely, the state where the power transmission path are made. Consequently, a power of the stepping moor 71 is transmitted to the output gear 75.

When the cam 64*d* is rotated in a clockwise direction in the state shown in FIG. 4, as described above, the sliding member 62 is moved to the leftward engaging position with respect to the clutch mechanisms 70*a*, 70*b*, 70*c*, and the arm 72 are engaged with the respective engaging portions 62*b* of the sliding member 62 and are rotated in a counter-clockwise direction. Consequently, the clutch mechanisms 70*a*, 70*b*, 70*c* are shifted to the disconnected state shown in FIG. 3.

Referring to FIGS. 1 and 2, unillustrated gears each engaged with the respective driving gears 73 transmit a power generated by the respective stepping motors 71 to rotate the respective photoconductive drums 51 of the respective image forming units 50*a*, 50*b*, 50*c*. On the other hand, each developing roller 54*a* is attached to each output gear 75. A power of the stepping motor 71 to the three developing rollers 54*a* is transmitted or broken concurrently with an operation of the cam driving motor 64*a*. Such clutch mechanism is not provided in the image forming unit 50*d* for a black color. A force generated by the stepping motor 71 (refer to FIG. 5) is constantly transmitted to the photoconductive drum 51 and the developing roller 54*a*.

In the case of forming a color image in the printer 10, the controller 12 controls the cam driving motor 64*a* to rotate the cam 64*d* one time in a counter-clockwise direction, and the locking member 63 locks the sliding member 62 at the disengaging position with respect to the clutch mechanism 70*a*, 70*b*, 70*c*. Consequently, even in the state where an electric power is not supplied to the cam driving motor 64*a*, the clutch mechanisms 70*a*, 70*b*, 70*c* maintain connecting state so that all of the photoconductive drums 51 and the developing rollers 54*a* of the respective image forming units 50*a*, 50*b*, 50*c*, 50*d* are rotated in accordance with a power transmitted by the corresponding stepping motors 71.

On the other hand, in the case of forming a monochromatic image, the controller 12 controls the cam driving motor 64*a* to rotate the cam 64*d* one time in a rightward direction, and the locking state by the locking member 63 is released. Accordingly, the sliding member 62 is moved to the engaging position with respect to the clutch mechanism 70*a*, 70*b*, 70*c* by a biasing force exerted by the coil spring 68. Consequently, even in the state where an electric power is not supplied to the cam driving motor 64*a*, the clutch mechanisms 70*a*, 70*b*, 70*c* maintain disconnecting state so that the photoconductive drums 51 of the image forming units 50*a*, 50*b*, 50*c* for respective colors of yellow, cyan, magenta are rotated in accordance with a power transmitted by the corresponding stepping motors 71. However, since a power is not transmitted to the developing rollers 54*a*, the developing rollers 54*a* are not rotated. At this time, the photoconductive drum 51 and the developing roller 54*a* of the image forming unit 50*d* for a black color are rotated by the stepping motor 71 (refer to FIG. 5).

Figure 5:
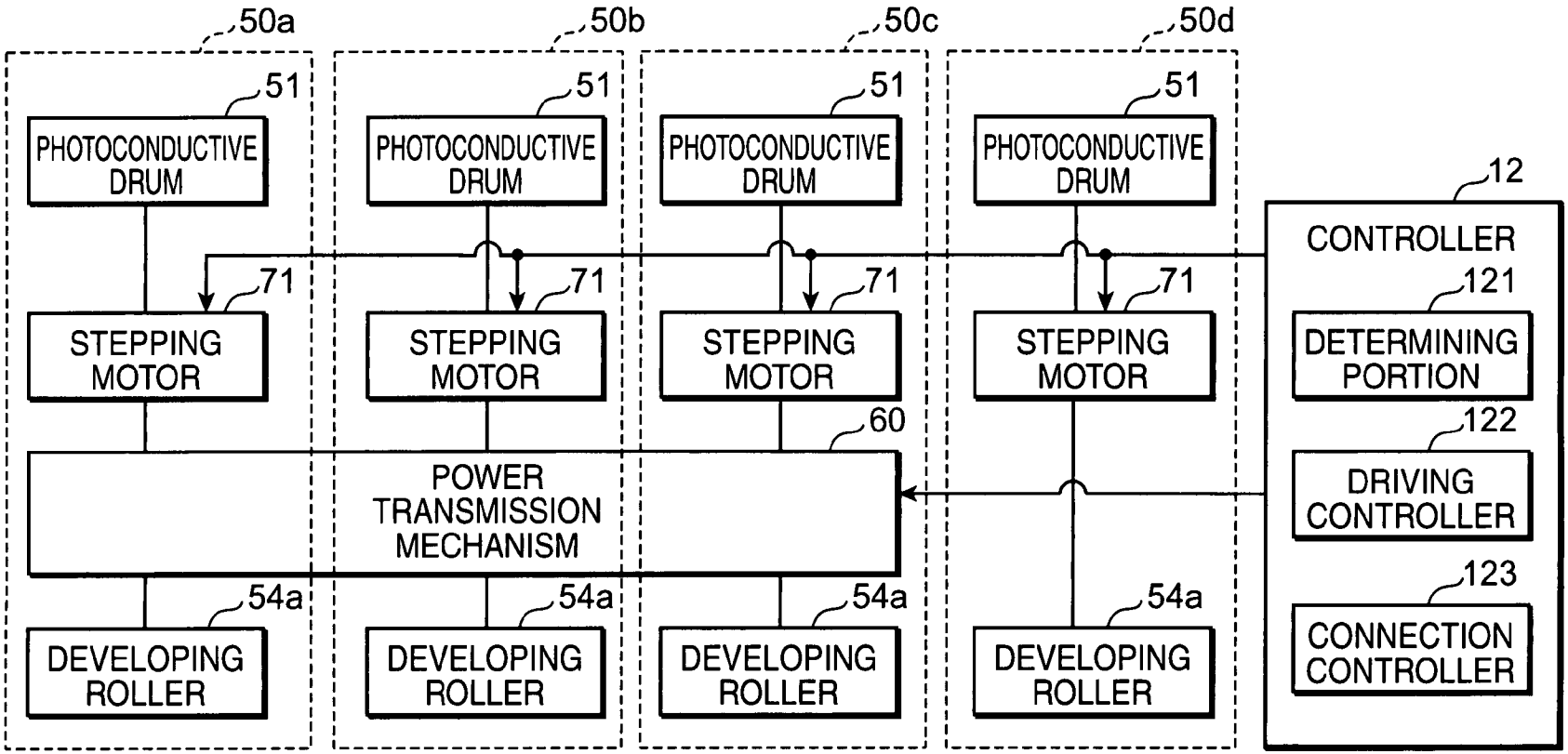
FIG. 5 is a block diagram showing an electrical construction of the printer relating to driving of a photoconductive drum and a developing section shown in FIG. 1.

FIG. 5 is a block diagram showing an electrical construction relating to driving of the photoconductive drum 51 and the developing device 54 in the printer 10.

As shown in FIG. 5, the printer 10 includes the image forming units 50*a*, 50*b*, 50*c*, 50*d* corresponding to the respective colors of yellow, cyan, magenta and black. Each of the image forming units 50*a*, 50*b*, 50*c*, 50*d* is so constructed that the photoconductive drum 51 and the developing roller 54*a* are driven by a common stepping motor 71.

Further, as described above, in each of the image forming units 50*a*, 50*b*, 50*c* for the respective colors of yellow, cyan, magenta, the power transmission mechanism 60 lies between the stepping motor 71 and the developing roller 54*a*. When a connecting operation is executed by the power transmission mechanism 60, the driving force generated by the stepping motor 71 is transmitted to the developing member 54. Accordingly, developing operation of colors corresponding to the image forming units 50*a*, 50*b*, 50*c* can be executed.

Meanwhile, in the case where a monochromatic image data and a color image data are mixed in a document image data transmitted from an external computer and the like, the need to switch the monochromatic printing state to the color printing state arises. In such a case, in the image forming units 50*a*, 50*b*, 50*c* for the respective colors of yellow, cyan, magenta, it is necessary to transmit the driving force generated by the stepping motor 71 to the developing roller 54*a*.

In that regard, when the connecting operation of the power transmission mechanism 60 is executed, a load is applied from the developing roller 54*a* to the stepping motor 71. Since the developing roller 54*a* has a relatively great weight, the load applied to the stepping motor 71 becomes so large if the output of the stepping motor 71 is maintained. Accordingly, there exists a likelihood that step-out of the stepping motor 71 occurs.

Therefore, in the present embodiment, when the monochromatic recording mode is switched to the color recording mode, the stepping motor 71 is controlled so that the output of the stepping motor 71 is lowered to the level of the driving speed at which the stepping motor can bear with a change in the load without causing the step-out even if the connecting operation by the power transmission mechanism 60 is executed.

To execute such operation, the controller 12 in the present embodiment includes a determining portion 121, a driving controller 122 and a connection controller 123. The controller 12 corresponds to an example of the controller.

The determining portion 121 determines whether the monochromatic printing should be performed or the color printing should be performed with regard to the respective document image data received from an external computer and the like.

Based on the result of the determination made by the determining portion 121, the driving controller 122 controls each of the stepping motors 71 of the respective image forming units 50*a*, 50*b*, 50*c*, 50*d* to lower a driving speed to a predetermined value when a switching of the monochromatic recording mode to the color recording mode is needed. In this case, for example, the predetermined value is a value corresponding to a value which is lower than one-half or three-fourth of the normal driving speed (the driving speed before being lowered) and is larger than zero.

When the driving speed of the stepping motor 71 is controlled by the driving controller 122 to be lowered to the predetermined value, the connection controller 123 controls the power transmission mechanism 60 to execute the connecting operation so as to transmit the driving force of the stepping motor 71 to the developing roller 54*a*.

Figure 6:
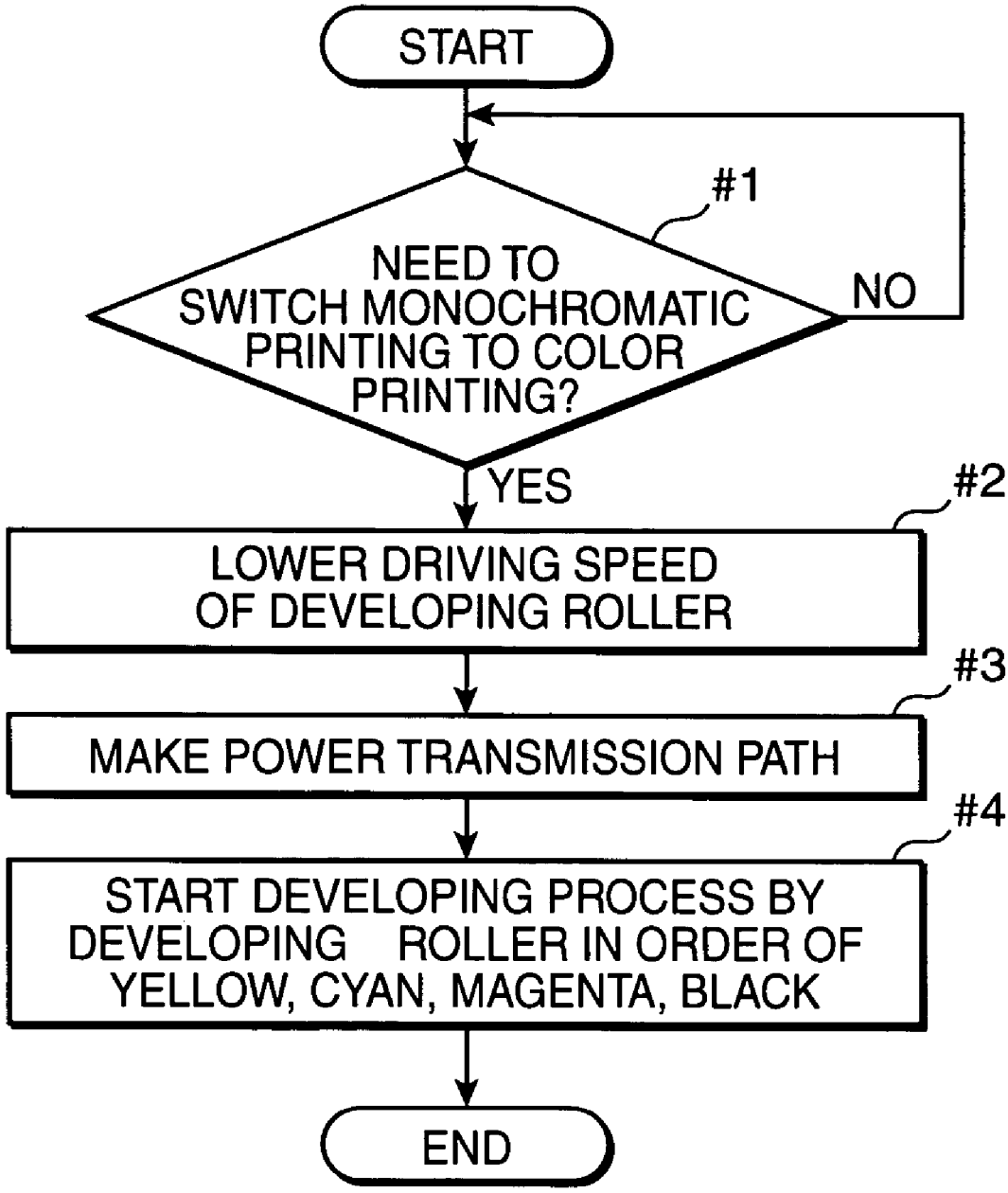
FIG. 6 is a flow chart showing an operation of the printer shown in FIG. 1.

FIG. 6 is a flow chart showing an operation of the printer 10. As shown in FIG. 6, the controller 12 determines whether it is necessary to switch the monochromatic recording mode to the color recording mode or not based on each document image data received from an external computer and the like (step #1). If the controller 12 determines that the switching is needed (YES in step #1), it lowers the output (rotational speed) of the stepping motors 71 of the respective image forming units 50*a*, 50*b*, 50*c*, 50*d*.

Then, the controller 12 controls the power transmission mechanism 60 to execute a connecting operation so that the driving force is transmitted to the developing rollers 54*a* of the respective image forming units 50*a*, 50*b*, 50*c* (step #3). Thereafter, at the timing where the color printing should be performed, the controller 12 controls the respective developing rollers 54*a* to start performing a developing operation in order of yellow, cyan, magenta, black.

As described above, when the monochromatic printing is switched to the color printing, driving of each developing roller 54*a* is started after the output of the stepping motor is lowered to the predetermined value which is higher than zero. Accordingly, the step-out occurred in the stepping motor 71 is can be suppressed. It is described above that the predetermined value corresponds to a value which is lower than one-half or three-fourth the normal driving speed (driving speed before lowered). However, if this value is set to be within the range having the minimum driving speed among the driving speeds accommodating the various kinds of recording sheet and recording modes, deterioration of quality of a printed image can be suppressed.

Further, by lowering the output of the stepping motors 71 of the respective image forming units 50*a*, 50*b*, 50*c* for the respective colors of yellow, cyan, magenta to the predetermined value which is higher than zero, the following effect can be obtained.

Figure 7:
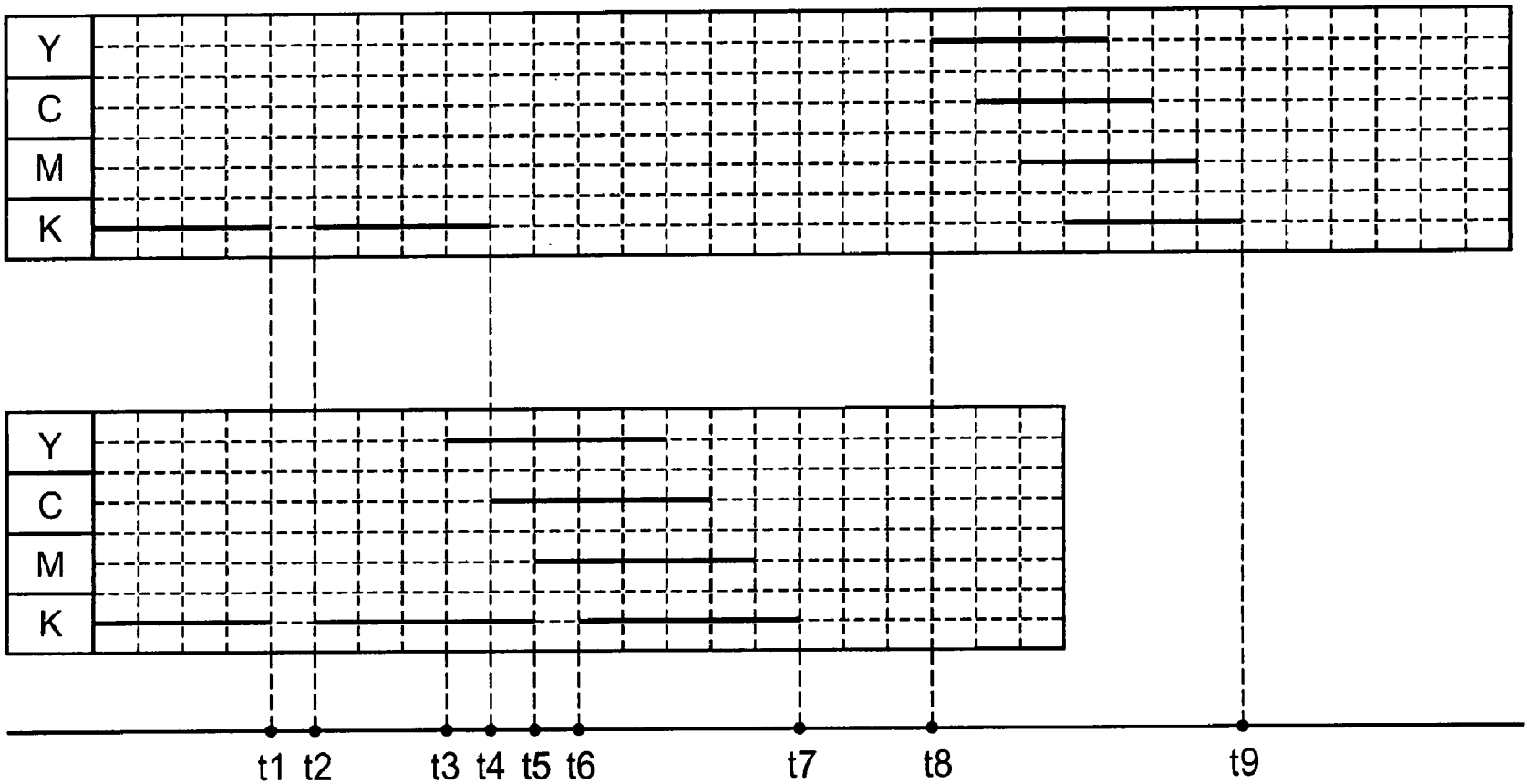
FIG. 7 is a timing chart for describing a developing operation of a developing roller of a conventional printer and a driving operation of the developing roller of the printer shown in FIG. 1 at the time of switching from a monochromatic recording mode to a color recording mode.

FIG. 7 is a timing chart for describing a developing operation of a developing roller at the time of switching the monochromatic recording mode to the color recording mode. Upper section of FIG. 7 shows a developing operation of respective developing rollers of the conventional printer. Lower section of FIG. 7 shows a developing operation of the respective developing rollers 54*a* of the present embodiment. Further, a horizontal axis of FIG. 7 shows a time flow. In a vertical axis of FIG. 7, "Y" denotes a developing roller corresponding to yellow, "C" denotes a developing roller corresponding to cyan, "M" denotes a developing roller corresponding to magenta, and "K" denotes a developing roller corresponding to black. Each solid line in FIG. 7 shows developing operations of the respective image forming units with regard to document image data. Length of each solid line shows a time length needed for developing a document in each image forming unit.

In the case where the need to print the third document image data by the color printing arises after the first and second document image data are printed by the monochromatic printing, in a conventional manner, when the normal developing operation (developing operation performed by the developing roller at the normal driving speed) with regard to the first and second document image data is finished at the time t4, all of the developing rollers are stopped temporarily at the time t4. Then, after the transfer (secondary transfer) of image to the intermediate transferring belt from the respective photoconductive drums is completed and preliminary rotation (idling operation for stabilizing the electrical potential of the photoconductive drum 51) is finished, the respective developing rollers start normal developing operation with regard to the third document image data from the time t8 with time differences in order of yellow, cyan, magenta and black. Accordingly, the color printing is performed.

On the other hand, as shown in the lower section of FIG. 7, in the present embodiment, if the determining portion 121 determines that the need to print the third document image data in color before the developing operation with regard to the second document image data is started, the driving controller 122 controls the stepping motor 71 of the image forming unit 50*d* of the monochromatic printing to lower the output so as to lower the driving speed of the developing roller 54*a* within a time period from the time t1 of completing the developing operation of the first document image data to the time t2 of starting the developing operation of the second document image data. The output of the stepping motor 71 at this time is substantially the same as the output of the stepping motor 71 at the time of developing the third or later document image data (hereinafter, referred to as a low speed mode). It should be noted that the time t5 of finishing the developing operation with regard to the second document image data in the present embodiment is later than the time t4 of finishing the developing operation with regard to the second document image data in a conventional image forming apparatus since the driving speed of the developing roller 54*a* is lowered as described above.

Herein, based on that a torque applied to the stepping motor 71 is equal to a torque applied to the developing roller 54*a*, a load applied to the stepping motor 71 becomes smaller by lowering the rotational speed, i.e. rotational force of the developing roller 54*a*. Thus, the load applied to the stepping motor 71 can be suppressed to be smaller by lowering the driving speed of the developing roller 54*a*.

Next, within the time period from the time t2 of starting the developing operation of the second document image data to the time t3 of starting the developing operation of the third document image data, the connection controller 123 controls the power transmission mechanism 60 to perform the connecting operation. After the connecting operation is completed, the developing operation executed by each of the developing rollers 54*a* for the respective colors of yellow, cyan, magenta and black is executed in order from the time t3 in the low speed mode.

Further, the driving controller 122 sets starting time of the developing operation of the third document image data, namely, the starting time t3 of the developing operation of the developing roller 54*a* of yellow toner so that the developing operation of the developing roller 54*a* for black color with regard to the third document image data at the time T=t6. The time T=t6 is a time point having a time interval substantially same as the interval between the time t1 to the time t2 from the time t5 of finishing the developing operation of the developing roller 54*a* for black with regard to the second document image data.

Herein, as comparing the conventional driving control shown in the upper section of FIG. 7 with the driving control of the present embodiment shown in the lower section of FIG. 7, since all of the developing rollers 54*a* are temporarily stopped at the time of switching the monochromatic recording mode to the color recording mode, waiting of completion of the transferring operation (secondary transfer) of image from the photoconductive drum 51 to the intermediate transferring belt 42 and a preliminary rotation (an idling operation for stabilizing an electrical potential of the surface of the photoconductive drum 51) are required. Consequently, the time at which all of the developing operations with regard to the third document image data becomes the time t9.

On the contrary, in the present embodiment, the output of the stepping motor 71 for the monochromatic printing is lowered to the level of output substantially the same as the output at the time of developing operation with regard to the third document image data before the color printing is performed. Accordingly, the waiting operation and the preliminary rotation become unnecessary. Consequently, the developing operation by each of the developing rollers 54*a* for the colors of yellow and cyan with regard to the third document image data can be performed in tandem with the developing operation by the developing roller 54*a* for a black color with regard to the second document image data.

Consequently, in the present embodiment, the time at which all of the developing operation with regard to the third document image data becomes the time T=t7 which is earlier than the conventional finishing time t9 so that the developing operation can be ended the time (t9-t7) earlier. Accordingly, the lowering of a printing speed at the time of switching from the monochromatic recording mode to the color recording mode can be suppressed.

Further, in the case where the driving speed of the developing rollers 54*a* is changed during the developing operation of the second document image data (monochromatic image), there is a concern of the printing quality of the document image. However, since the image forming is performed by the image forming unit 50*d* (black) singly and the problems of a color drift due to a timing of image forming performed by the plurality of the image forming unit and brilliance of toner due to delay in a timing for fixing do not occur, it is considered that there is no great effect with respect to an image quality.

Further, restoration to the normal driving speed can be executed after the developing operation with regard to the third document image data is completed in the above-described example, or, if it is possible, the restoration can be performed before the developing operation with regard to the third document image data is started.

As described above, the image forming apparatus according to an embodiment of the present invention comprises: an image bearing member for bearing an electrostatic latent image; a driving section for driving the image bearing member; a developing section for developing the electrostatic latent image formed on the image bearing member by toner particles; a power transmission section provided between the driving section and the developing section for making and breaking a power transmission path of transmitting a driving force generated by the driving section to the developing section; and a controller for controlling the driving section and the power transmission section, the controller controlling the driving section to lower its output to a predetermined value before transmitting a driving force of the driving section to the developing section, and controlling the power transmission section to make the power transmission path between the driving section and the developing section after the output of the driving section is lowered to the predetermined value.

In the image forming apparatus, when the need to transmit the driving force of the driving section also to the developing section arises, the power transmission path is made between the driving section and the developing section after the controller controls the driving section to lower its output to the predetermined value. Accordingly, a great load applied by the developing section to the driving section at the time of making the power transmission path can be prevented or suppressed. Consequently, occurrence of a step-out in the driving section can be prevented or suppressed so that operating life of the driving section can be made longer.

It is preferable that a plurality of image forming units each including the image bearing member, the developing section and the driving section are provided in accordance with a plurality of toners having different colors, and the plurality of image forming units are arranged in a predetermined direction to superimposedly transfer toner images of respective colors to a recording sheet being conveyed in the predetermined direction.

In this case, a plurality of image forming units each including the image bearing member, the developing section and the driving section are provided in accordance with a plurality of toners having different colors, and the plurality of image forming units are arranged in a predetermined direction to superimposedly transfer toner images of respective colors to a recording sheet being conveyed in the predetermined direction. Accordingly, a great load applied to the respective driving sections of one or more image forming units can be prevented or suppressed.

It is preferable that the plurality of toners include a toner having a first color and toners having a plurality of colors other than the first color, the image forming apparatus has a first mode of executing an image forming using only the toner having the first color and a second mode of executing an image forming using at least the toners having the plurality of colors, the power transmission section makes and breaks the power transmission path of transmitting the driving force generated by the driving section between the driving section and the developing section of each of the image forming units corresponding to the toners having the plurality of colors, and the controller controls, when the first mode is switched to the second mode, the driving section of each of the plurality of image forming units corresponding to the toners having the plurality of colors to lower its output to a predetermined value, and controls the power transmission section to make the power transmission path between the driving section and the developing section after the output of the driving section is lowered to the predetermined value.

In this case, at the time of switching the first mode to the second mode where the need to transmit the driving force generated by the driving section to the developing section of each of the image forming units corresponding to the toners having the plurality of colors arises, the controller controls the power transmission section to make the power transmission path after the driving section of each of the plurality of image forming units corresponding to the toners having the plurality of colors to lower its output to the predetermined value. Accordingly, great load applied to the driving section of each of the plurality of image forming units corresponding to the toners having the plurality of colors can be prevented or suppressed.

It is preferable that the controller controls, before the first mode is switched to the second mode, the driving section of the image forming unit corresponding to the toner having the first color to lower its output to the predetermined value.

In this case, the controller controls the driving section of the image forming unit corresponding to the toner having the first color to lower its output to the predetermined value. Accordingly, as compared to the case where the controller does not control the driving section of the image forming unit corresponding to the toner having the first color to lower its output to the predetermined value in advance before the mode is switched, the start timing of transmitting the driving force to the respective developing section of the image forming units corresponding to the toners having the plurality of colors can be made earlier.

Namely, in the case of maintaining the output of the driving section of the image forming unit corresponding to the toner having the first color in advance before the mode is switched, the driving speed (developing speed) of the developing section of the image forming unit corresponding to the toner having the first color and the driving speed of the respective developing sections of the plurality of image forming units corresponding to the toners having the plurality of colors after the mode is switched are different. Therefore, the developing operation of these units cannot be executed in tandem, and the developing operation of the developing section of the plurality of image forming units corresponding to the toners having the plurality of colors needs to be held until the developing operation of the developing section of the image forming unit corresponding to the toners of the first color. However, in the above case, the driving speed (developing speed) of the developing section of the image forming unit corresponding to the toner having the first color and the driving speed of the respective developing sections of the plurality of image forming units corresponding to the toners having the plurality of colors after the mode is switched can be made the same. Consequently, the waiting time is not needed, and the start timing of transmitting the driving force to the developing section of the plurality of the image forming units corresponding to the toners having the plurality of colors can be made the waiting time earlier.

It is preferable that the driving section includes a rotating device for generating a rotational driving force, and the controller controls the rotating device to lower the rotational speed of the rotating device from a first rotational speed to a second rotational speed before transmitting the rotational driving force of the rotating device to the developing section, and controls the power transmission section to make the power transmission path between the rotating device and the developing section after the rotational speed of the rotating device lowers to the second rotational speed.

In this case, since the rotational speed of the rotating device is lowered from the first rotational speed to the second rotational speed before transmitting the rotational driving force of the rotating device to the developing section, a rotational load generated by the developing section can be transmitted to the rotational device in the state where a torque generated by the rotational device is increased while the rotational load generated by the developing section is decreased. Accordingly, the step-out occurred in the rotational device can be assuredly prevented.

It is preferable that the toners include a toner of black for use in a monochromatic printing, and toners of yellow, cyan and magenta for use in a color printing; the image forming apparatus has a monochromatic recording mode of executing image forming using only the toner of black and a color recording mode of executing image forming using the toners of black, yellow, cyan and magenta, a first to fourth image forming units each including the image bearing member, the developing section and the rotating device are provided in accordance with the toners of black, yellow, cyan and magenta; the rotating device of the first image forming unit drives the developing section of the first image forming unit; the power transmission section makes and breaks power transmission paths for transmitting rotational driving forces generated by the rotating devices of the second to fourth image forming units to the respective developing sections between the rotating devices and the developing sections; and the controller controls the respective rotating devices of the second to fourth image forming units to lower the rotational speeds of the rotating devices from the first rotational speed to the second rotational speed before transmitting the rotational driving forces of the rotating devices to the respective developing sections, and controls the power transmission section to make power transmission paths between the rotating devices and the developing sections after the rotational speeds of the rotating devices are lowered to the second rotational speed.

In this case, since the rotational speeds of the respective rotating devices are lowered from the first rotational speed to the second rotational speed before transmitting the rotational driving forces of the rotating devices are transmitted to the respective developing sections in the second to fourth image forming units, the rotational loads generated by the respective developing sections of the second to fourth image forming units can be transmitted to the rotational devices in the state where torques generated by the rotational devices are increased while the rotational loads generated by the developing sections are decreased. Accordingly, the step-out occurred in the rotational devices can be assuredly prevented. Consequently, a transition of the monochromatic recording mode to the color recording mode can be assuredly executed.

It is preferable that the controller controls, before the first image forming unit performs image forming onto a last recording sheet in the monochromatic recording mode, the respective rotating devices of the first to fourth image forming units to lower their respective rotational speeds from the first rotational speed to the second rotational speed, and controls the first image forming unit to perform image forming onto the last recording sheet in the monochromatic recording mode, and controls the power transmission section to make power transmission paths between the rotating devices of the second to fourth image forming units and their respective developing sections after the rotational speeds of their respective rotating devices are lowered to the second rotational speed, and controls at least one of the second to fourth image forming units to start image forming on a first recording sheet in the color recording mode within a period during which the first image forming unit performs image forming on the last recording sheet in the monochromatic recording mode.

In this case, the rotational speed of the rotational device in the image forming performed onto the last recording sheet in the monochromatic recording mode and the rotational speeds of the rotational devices in the image forming performed in the color recording mode can be matched. Accordingly, it is not necessary to provide a waiting time in the second to fourth image forming units at the time of switching the monochromatic recording mode to the color recording mode. Consequently, the document in which the monochromatic printing and the color printing are mixed can be printed at high speed.

It is preferable that the controller controls the one of the second to fourth image forming units that is operated at first to start image forming onto a first recording sheet in the color recording mode so as to make: a period from the finish of the image forming onto a last recording sheet by the first image forming unit in the monochromatic recording mode to the start of the image forming onto a first recording sheet by the first image forming unit in the color recording mode the same as a period from the finish of the image forming onto one recording sheet immediately before the last recording sheet by the first image forming unit in the monochromatic recording mode to the start of the image forming onto the last recording sheet by the first image forming unit in the monochromatic recording mode.

In this case, the controller controls the one of the second to fourth image forming units that is operated at first to start image forming onto a first recording sheet in the color recording mode so as to make a period from the finish of the image forming onto a last recording sheet by the first image forming unit in the monochromatic recording mode to the start of the image forming onto a first recording sheet by the first image forming unit in the color recording mode the same as a period from the finish of the image forming onto one recording sheet immediately before the last recording sheet by the first image forming unit in the monochromatic recording mode to the start of the image forming onto the last recording sheet by the first image forming unit in the monochromatic recording mode. Accordingly, a time required for switching the monochromatic recording mode to the color recording mode can be suppressed to be the minimum. Consequently, the document in which the monochromatic printing and the color printing are mixed can be printed at farther high speed.

This application is based on patent application No. 2005-214699 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are intended to be embraced by the claims.

What is claimed is:

1. An image forming apparatus comprising:

an image bearing member for bearing an electrostatic latent image;

a driving section for driving the image bearing member;

a developing section for developing the electrostatic latent image formed on the image bearing member by toner particles;

a power transmission section provided between the driving section and the developing section for making and breaking a power transmission path of transmitting a driving force generated by the driving section to the developing section; and a controller for controlling the driving section and the power transmission section, the controller controlling the driving section to lower its output to a predetermined value before transmitting a driving force of the driving section to the developing section, and controlling the power transmission section to make the power transmission path between the driving section and the developing section after the output of the driving section is lowered to the predetermined value.

2. An image forming apparatus according to claim 1, wherein a plurality of image forming units each including the image bearing member, the developing section and the driving section are provided in accordance with a plurality of toners having different colors, and the plurality of image forming units are arranged in a predetermined direction to superimposedly transfer toner images of respective colors to a recording sheet being conveyed in the predetermined direction.

3. An image forming apparatus according to claim 2, wherein the plurality of toners include a toner having a first color and toners having a plurality of colors other than the first color, the image forming apparatus has a first mode of executing an image forming using only the toner having the first color and a second mode of executing an image forming using at least the toners having the plurality of colors, the power transmission section makes and breaks the power transmission path of transmitting the driving force generated by the driving section between the driving section and the developing section of each of the image forming units corresponding to the toners having the plurality of colors, and the controller controls, when the first mode is switched to the second mode, the driving section of each of the image forming units corresponding to the toners having the plurality of colors to lower its output to a predetermined value, and controls the power transmission section to make the power transmission path between the driving section and the developing section after the output of the driving section is lowered to the predetermined value.

4. An image forming apparatus according to claim 3, wherein the controller controls, before the first mode is switched to the second mode, the driving section of the image forming unit corresponding to the toner having the first color to lower its output to the predetermined value.

5. An image forming apparatus according to claim 1, wherein the driving section includes a rotating device for generating a rotational driving force, and the controller controls the rotating device to lower the rotational speed of the rotating device from a first rotational speed to a second rotational speed before transmitting the rotational driving force of the rotating device to the developing section, and controls the power transmission section to make the power transmission path between the rotating device and the developing section after the rotational speed of the rotating device lowers to the second rotational speed.

6. An image forming apparatus according to claim 5, wherein:

the toners include a toner of black for use in a monochromatic printing, and toners of yellow, cyan and magenta for use in a color printing;

the image forming apparatus has a monochromatic recording mode of executing image forming using only the toner of black and a color recording mode of executing image forming using the toners of black, yellow, cyan and magenta;

a first to fourth image forming units each including the image bearing member, the developing section and the rotating device are provided in accordance with the toners of black, yellow, cyan and magenta;

the rotating device of the first image forming unit drives the developing section of the first image forming unit;

the power transmission section makes and breaks power transmission paths for transmitting rotational driving forces generated by the rotating devices of the second to fourth image forming units to the respective developing sections between the rotating devices and the developing sections; and the controller controls the respective rotating devices of the second to fourth image forming units to lower the rotational speeds of the rotating devices from the first rotational speed to the second rotational speed before transmitting the rotational driving forces of the rotating devices to the respective developing sections, and controls the power transmission section to make power transmission paths between the rotating devices and the developing sections after the rotational speeds of the rotating devices are lowered to the second rotational speed.

7. An image forming apparatus according to claim 6, wherein the controller controls, before the first image forming unit performs image forming onto a last recording sheet in the monochromatic recording mode, the respective rotating devices of the first to fourth image forming units to lower their respective rotational speeds from the first rotational speed to the second rotational speed, and controls the first image forming unit to perform image forming onto the last recording sheet in the monochromatic recording mode, and controls the power transmission section to make power transmission paths between the rotating devices of the second to fourth image forming units and their respective developing sections after the rotational speeds of their respective rotating devices are lowered to the second rotational speed, and controls at least one of the second to fourth image forming units to start image forming on a first recording sheet in the color recording mode within a period during which the first image forming unit performs image forming on the last recording sheet in the monochromatic recording mode.

8. An image forming apparatus according to claim 7, wherein:

the controller controls the one of the second to fourth image forming units that is operated at first to start image forming onto a first recording sheet in the color recording mode so as to make:

a period from the finish of the image forming onto a last recording sheet by the first image forming unit in the monochromatic recording mode to the start of the image forming onto a first recording sheet by the first image forming unit in the color recording mode the same as a period from the finish of the image forming onto one recording sheet immediately before the last recording sheet by the first image forming unit in the monochromatic recording mode to the start of the image forming onto the last recording sheet by the first image forming unit in the monochromatic recording mode.

* * * * *